US011557258B2

(12) United States Patent
Kim et al.

(10) Patent No.: US 11,557,258 B2
(45) Date of Patent: Jan. 17, 2023

(54) ELECTROLUMINESCENCE DISPLAY APPARATUS AND DRIVING METHOD THEREOF

(71) Applicant: LG DISPLAY CO., LTD., Seoul (KR)

(72) Inventors: Min Koo Kim, Paju-si (KR); Tae Young Lee, Paju-si (KR); Sang Goo Jeong, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/743,565

(22) Filed: May 13, 2022

(65) Prior Publication Data

US 2022/0383825 A1 Dec. 1, 2022

(30) Foreign Application Priority Data

May 28, 2021 (KR) ..... 10-2021-0069407

(51) Int. Cl.
*G09G 3/3291* (2016.01)

(52) U.S. Cl.
CPC ..... *G09G 3/3291* (2013.01); *G09G 2310/027* (2013.01); *G09G 2310/0291* (2013.01)

(58) Field of Classification Search
CPC ..... G09G 3/3233; G09G 3/3258; G09G 2300/0819; G09G 2300/043; G09G 2320/0295; G09G 2320/043; G09G 2320/0233; G09G 2320/045; G09G 2320/0223
See application file for complete search history.

(56) References Cited

U.S. PATENT DOCUMENTS

2008/0180426 A1* 7/2008 Liu ..... G09G 3/20 345/207
2015/0379937 A1* 12/2015 Kim ..... G09G 3/3275 345/691
2016/0189629 A1* 6/2016 Jin ..... G09G 3/3233 345/76
2017/0025061 A1* 1/2017 Takizawa ..... G09G 3/3291
(Continued)

FOREIGN PATENT DOCUMENTS

KR 10-2006-0073682 6/2006

*Primary Examiner* — Dong Hui Liang
(74) *Attorney, Agent, or Firm* — Polsinelli PC

(57) ABSTRACT

In an electroluminescence display apparatus and a driving method of an electroluminescence display apparatus, the electroluminescence display apparatus includes a pixel connected to a data line and a reference voltage line, the pixel including a driving element configured to generate a driving current based on a sensing data voltage supplied through the data line and a reference voltage supplied through the reference voltage line, and a level of the driving current being proportional to a level of the sensing data voltage, a comparison and tracking circuit configured to previously determine a target current range between a reference low current and a reference high current and change current tracking data for adjusting a level of the sensing data voltage until the driving current input through the reference voltage line is within the target current range, and a digital-to-analog converter configured to adjust a level of the sensing data voltage so as to be proportional to a size of the current tracking data and supply the level-adjusted sensing data voltage to the data line.

15 Claims, 9 Drawing Sheets

(56) References Cited

U.S. PATENT DOCUMENTS

| | | | | |
|---|---|---|---|---|
| 2018/0053462 | A1* | 2/2018 | Bae | G09G 3/2074 |
| 2018/0166020 | A1* | 6/2018 | Hwang | G09G 3/3233 |
| 2020/0168154 | A1* | 5/2020 | Cheng | G09G 3/3258 |

* cited by examiner

FIG. 7

| | Display Driving | Sensing Driving |
|---|---|---|
| EVDD | EVDD1 | EVDD2 |
| EVSS | EVSS1 | EVSS2 |

FIG. 8

| | C1 | C2 | F0 |
|---|---|---|---|
| REF-LOW ≤ Isen ≤ REF-HIGH | 0 | 0 | HOLD |
| REF-HIGH < Isen | 1 | 0 | DN |
| Isen < REF-LOW | 0 | 1 | UP |

ELECTROLUMINESCENCE DISPLAY APPARATUS AND DRIVING METHOD THEREOF

CROSS-REFERENCE TO RELATED APPLICATION

This application claims the benefit of the Korean Patent Application No. 10-2021-0069407 filed on May 28, 2021, which is hereby incorporated by reference in its entirety.

BACKGROUND

Field of the Disclosure

The present disclosure relates to an electroluminescence display apparatus and a driving method thereof.

Description of the Background

In electroluminescence display apparatuses having an active matrix type, a plurality of pixels each including a light emitting device and a driving element are arranged as a matrix type, and the luminance of an image implemented by the pixels is adjusted based on a gray level of image data. The driving element controls a pixel current flowing in the light emitting device based on a voltage (hereinafter referred to as a gate-source voltage) applied between a gate electrode and a source electrode thereof. The amount of light emitted by the light emitting device and the luminance of a screen are determined based on a pixel current.

Because a threshold voltage of a driving element determines a driving characteristic of a pixel, the threshold voltage should be constant in all pixels, but a driving characteristic between pixels may be changed by various causes such as a process characteristic and a degradation characteristic. Such a driving characteristic difference causes a luminance deviation, and due to this, there is a limitation in implementing an image.

Compensation technology for compensating for a luminance deviation between pixels has been proposed, but is not high in compensation performance due to noise occurring in a sensing process.

SUMMARY

Accordingly, the present disclosure is directed to an electroluminescence display apparatus and a driving method thereof that substantially obviate one or more of problems due to limitations and disadvantages described above.

More specifically, the present disclosure is to provide an electroluminescence display apparatus for increasing sensing performance and compensation performance and a driving method thereof.

To achieve these and other advantages and in accordance with the purpose of the disclosure, as embodied and broadly described herein, an electroluminescence display apparatus includes a pixel connected to a data line and a reference voltage line, the pixel including a driving element configured to generate a driving current based on a sensing data voltage supplied through the data line and a reference voltage supplied through the reference voltage line, and a level of the driving current being proportional to a level of the sensing data voltage, a comparison and tracking unit configured to previously determine a target current range between a reference low current and a reference high current and change current tracking data for adjusting a level of the sensing data voltage until the driving current input through the reference voltage line is within the target current range, and a digital-to-analog converter configured to adjust a level of the sensing data voltage so as to be proportional to a size of the current tracking data and supply the level-adjusted sensing data voltage to the data line.

In another aspect of the present disclosure, a driving method of an electroluminescence display apparatus, including a pixel which is connected to a data line and a reference voltage line and includes a driving element configured to generate a driving current based on a sensing data voltage supplied through the data line and a reference voltage supplied through the reference voltage line and where a level of the driving current being proportional to a level of the sensing data voltage, includes predetermining a target current range between a reference low current and a reference high current and changing current tracking data for adjusting a level of the sensing data voltage until the driving current input through the reference voltage line is within the target current range and adjusting a level of the sensing data voltage so as to be proportional to a size of the current tracking data and supplying the level-adjusted sensing data voltage to the data line.

BRIEF DESCRIPTION OF THE DRAWINGS

The accompanying drawings, which are included to provide a further understanding of the disclosure and are incorporated in and constitute a part of this application, illustrate aspect(s) of the disclosure and together with the description serve to explain the principle of the disclosure.

In the drawings:

FIG. 7 is a diagram illustrating a first source voltage and a second source voltage for display driving and sensing driving in the driving system of FIG. 5;

FIG. 8 is a diagram illustrating an example of a current tracking feedback operation performed in the driving system of FIG. 5;

DETAILED DESCRIPTION

Figure 1:
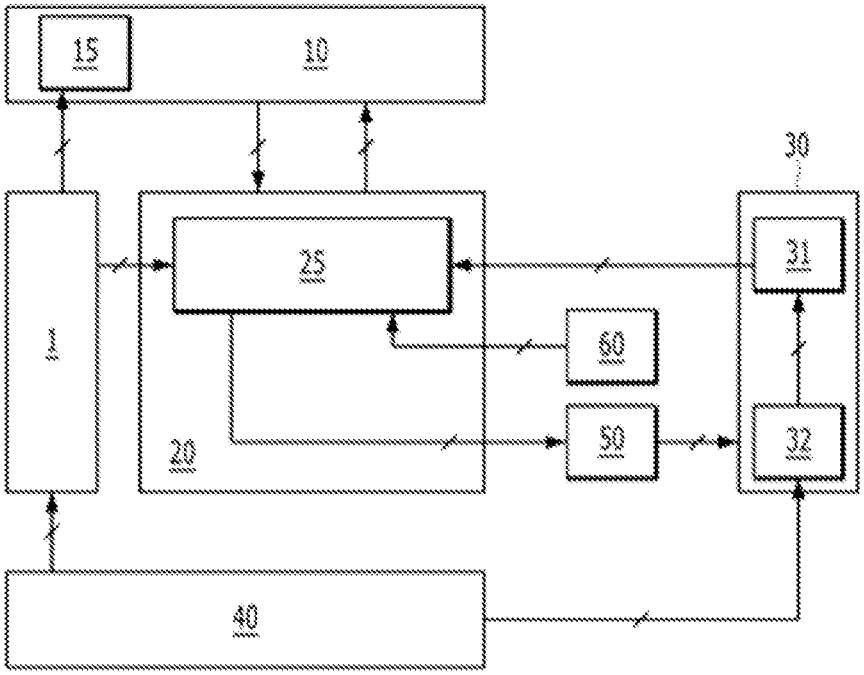
FIG. 1 is a diagram illustrating an electroluminescence display apparatus according to the present disclosure.

Hereinafter, the present disclosure will be described more fully with reference to the accompanying drawings, in which exemplary aspects of the disclosure are shown. The disclosure may, however, be embodied in many different forms and should not be construed as being limited to the aspects set forth herein; rather, these aspects are provided so that this disclosure will be thorough and complete, and will fully convey the concept of the disclosure to those skilled in the art.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Furthermore, the present disclosure is only defined by scopes of claims.

The shapes, sizes, ratios, angles, numbers and the like disclosed in the drawings for description of various aspects of the present disclosure to describe aspects of the present disclosure are merely exemplary and the present disclosure is not limited thereto. Like reference numerals refer to like elements throughout. Throughout this specification, the same elements are denoted by the same reference numerals. As used herein, the terms "comprise", "having," "including" and the like suggest that other parts can be added unless the term "only" is used. As used herein, the singular forms "a", "an", and "the" are intended to include the plural forms as well, unless context clearly indicates otherwise.

Elements in various aspects of the present disclosure are to be interpreted as including margins of error even without explicit statements.

In describing a position relationship, for example, when a position relation between two parts is described as "on~", "over~", "under~", and "next~", one or more other parts may be disposed between the two parts unless "just" or "direct" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Like reference numerals refer to like elements throughout.

In the specification, a pixel circuit provided on a substrate of a display panel may be implemented with a thin film transistor (TFT) having an n-type metal oxide semiconductor field effect transistor (MOSFET) structure, but is not limited thereto and may be implemented with a TFT having a p-type MOSFET structure. A TFT may be a three-electrode element which includes a gate, a source, and a drain. The source may be an electrode which supplies a carrier to a transistor. In the TFT, a carrier may start to flow from the source. The drain may be an electrode which enables the carrier to flow out from the TFT. That is, in a MOSFET, the carrier flows from the source to the drain. In the n-type TFT (NMOS) because a carrier is an electron, a source voltage may have a lower voltage than a drain voltage so that the electron flows from the source to the drain. In the n-type TFT, because the electron flows from the source to the drain, a current may flow from the drain to the source. On the other hand, in the p-type TFT (PMOS), because a carrier is a hole, a source voltage may be higher than a drain voltage so that the hole flows from the source to the drain. In the p-type TFT, because the hole flows from the source to the drain, a current may flow from the source to the drain. It should be noted that a source and a drain of a MOSFET are not fixed but switch therebetween. For example, the source and the drain of the MOSFET may switch therebetween.

Moreover, in the present disclosure, a semiconductor layer of a TFT may be implemented with at least one of an oxide element, an amorphous silicon element, and a polysilicon element.

In the following description, when the detailed description of the relevant known function or configuration is determined to unnecessarily obscure the important point of the present disclosure, the detailed description will be omitted. Hereinafter, aspects of the present disclosure will be described in detail with reference to the accompanying drawings.

Figure 2:
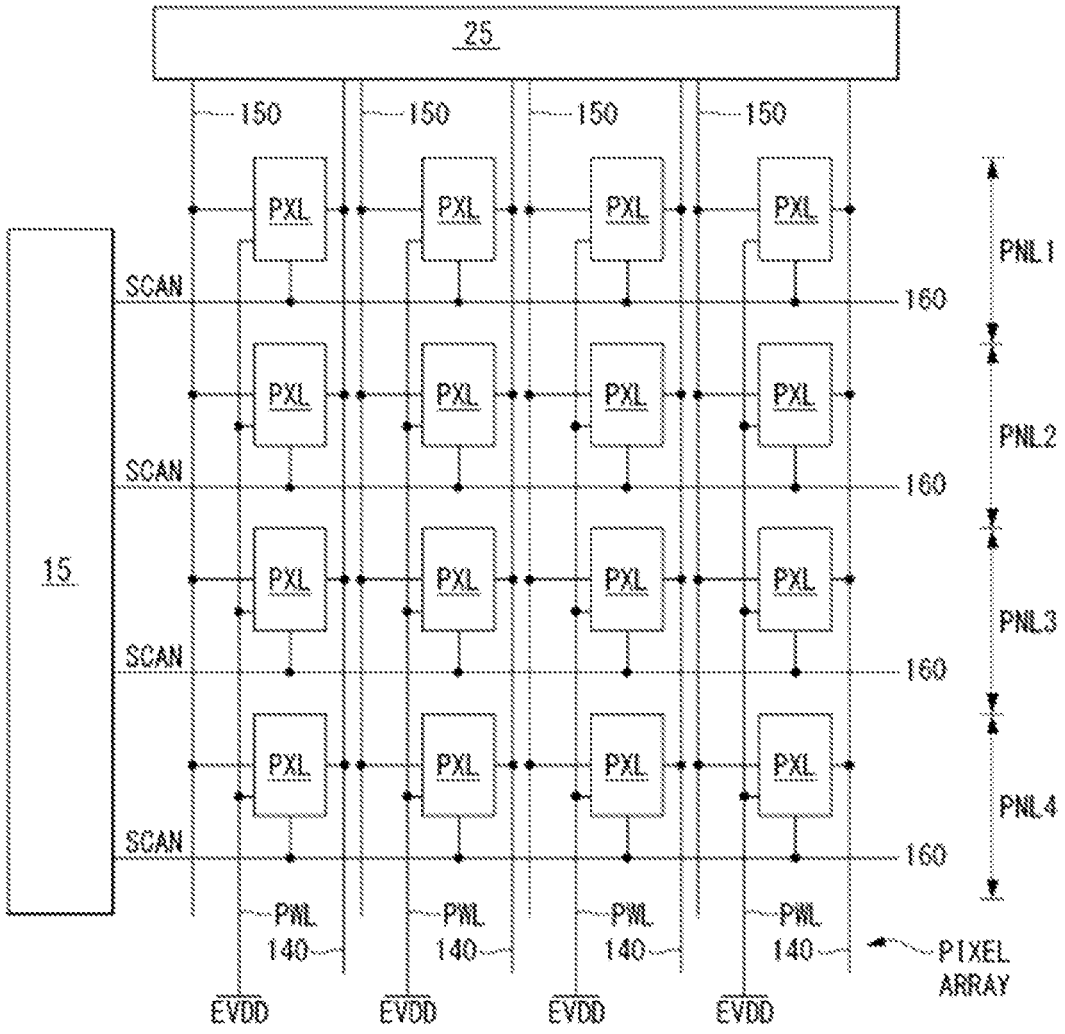
FIG. 2 is a diagram illustrating an example of a pixel array included in the display panel of FIG. 1.

FIG. 1 is a diagram illustrating an electroluminescence display apparatus according to an aspect of the present disclosure. FIG. 2 is a diagram illustrating an example of a pixel array included in the display panel of FIG. 1.

Referring to FIGS. 1 and 2, the electroluminescence display apparatus according to an aspect of the present disclosure may include a timing controller 1, a display panel 10, a driver integrated circuit (IC) 20, a compensation IC 30, a host system 40, a storage memory 50, and a power circuit 60. A gate driving circuit 15 included in the display panel 10 and a data driving circuit 25 embedded into the driver IC 20 may drive pixels PXL included in the display panel 10.

The display panel 10 may include a plurality of pixel lines PNL1 to PNL4, and each of the pixel lines PNL1 to PNL4 may include a plurality of pixels PXL and a plurality of signal lines. A "pixel line" described herein may not be a physical signal line and may denote a set of signal lines and pixels PXL adjacent to one another in an extension direction of a gate line. The signal lines may include a plurality of data lines 140 for supplying a display data voltage and a sensing data voltage to the pixels PXL, a plurality of reference voltage lines 150 for supplying a reference voltage to the pixels PXL, a plurality of gate lines 160 for supplying a gate signal SCAN to the pixels PXL, and a plurality of first power lines PWL for supplying a first source voltage EVDD to the pixels PXL.

The pixel PXL of the display panel 10 may be arranged as a matrix type to configure a pixel array. Each pixel PXL included in the pixel array of FIG. 2 may be connected to one of the data lines 140, one of the reference voltage lines 150, one of the first power lines PWL, and one of the gate lines 160. Each pixel PXL included in the pixel array of FIG. 2 may be connected to the plurality of gate lines 160. Also, each pixel PXL included in the pixel array of FIG. 2 may be further supplied with a second source voltage from the power circuit 60. The power circuit 60 may supply the second source voltage to the pixel PXL through a low level power line or a pad part.

The timing controller 1 may generate a gate timing control signal for controlling an operation timing of the gate driving circuit 15 and a data timing control signal for controlling an operation timing of the data driving circuit 25 with reference to timing signals (for example, a vertical synchronization signal Vsync, a horizontal synchronization signal Hsync, a dot clock signal DCLK, and a data enable signal DE) input from a host system 40.

The data timing control signal may include a source start pulse, a source sampling clock, and a source output enable signal, but is not limited thereto. The source start pulse may control a data sampling start timing of the driving voltage generating circuit 23. The gate timing control signal may include a gate start pulse and a gate shift clock, but is not limited thereto. The gate start pulse may be applied to a gate stage which generates a first gate output and may activate an operation of the gate stage. The gate shift clock may be input to the gate stages in common and may be a clock signal for shifting the gate start pulse.

The timing controller 1 may control a sensing driving timing and a display driving timing of the pixel lines PNL1 to PNL4 of the display panel 10 based on a predetermined sequence, and thus, may implement a display driving operation and a sensing driving operation. The display driving operation and the sensing driving operation may be differently performed by operations of the gate driving circuit 15 and the data driving circuit 25 performed based on control by the timing controller 1.

Sensing driving may denote an operation which applies the sensing data voltage to pixels PXL included a sensing target pixel line to sense a threshold voltage variation of each of corresponding pixels PXL and updates a compensation value for compensating for a threshold voltage variation of each of the corresponding pixels PXL based on sensing result data. Also, display driving may denote an operation which corrects digital image data, which is to be input to corresponding pixels PXL, based on an updated compensation value and applies the display data voltage corresponding to corrected image data to the corresponding pixels PXL to display an input image on a screen (hereinafter referred to as screen reproduction).

The display driving operation may be performed in a vertical active period where the data enable signal is shifted between a logic high level and a logic low level in one frame, and the sensing driving operation may be performed in a vertical blank period except the vertical active period in one frame. In the vertical blank period, the data enable signal may continuously maintain a logic low level. The sensing driving operation may be performed in a power-on period until before screen reproduction starts after a system main power is applied thereto, or may be performed in a power-off period until before the system main power is released after the screen reproduction ends.

The gate driving circuit 15 may be embedded into the display panel 10. The gate driving circuit 15 may be disposed in a non-display area outside a display area where the pixel array is provided. The gate driving circuit 15 may include a plurality of gate stages connected to the gate lines 160 of the pixel array. The gate stages may generate the gate signal SCAN for controlling switch elements of the pixels PXL and may supply the gate signal SCAN to the gate lines 160.

The data driving circuit 25 embedded into the driver IC 20 may include a plurality of comparison and tracking units and a plurality of digital-to-analog converters.

In display driving, each of the comparison and tracking units may supply the reference voltage to the reference voltage line 150, and each of the digital-to-analog converters may generate a display data voltage and may supply the display data voltage to the data line 140. In display driving, a display driving current may flow in a driving element of a pixel PXL based on a display data voltage and the reference voltage, and a light emitting device of the pixel PXL may emit light with the display driving current, whereby an image may be reproduced on a screen.

In sensing driving, each of the comparison and tracking units may supply the reference voltage to the reference voltage line 150, and then, when a driving current input through the reference voltage line 150 is within a predetermined target current range, a gate-source voltage of a driving element included in a corresponding pixel may be calculated as a threshold voltage of the driving element. In sensing driving, each of the digital-to-analog converters may adjust a level of a sensing data voltage based on current tracking data until the driving current input through the reference voltage line 150 is within the target current range and may transfer a level-adjusted sensing data voltage to the data line 140. In sensing driving, because a level of the driving current satisfying the target current range is far lower than that of the display driving current, a time taken in sensing may be largely shortened.

Each of the comparison and tracking units of the data driving circuit 25 may convert a detected threshold voltage of the driving element into digital sensing result data and may supply the digital sensing result data to the storage memory 50. The storage memory 50 may be implemented as flash memory, but is not limited thereto.

The compensation IC 30 may include a compensation circuit 31 and a compensation memory 32. The compensation memory 32 may transfer the digital sensing result data, read from the storage memory 50, to the compensation circuit 31. The compensation memory 32 may be random access memory (RAM) (for example, double data rate synchronous dynamic RAM (DDR SDRAM), but is not limited thereto. The compensation circuit 31 may calculate a compensation offset and a compensation gain for each pixel based on the digital sensing result data, correct digital image data input from the host system 40 based on the calculated compensation offset and compensation gain, and supply the corrected image data to the driver IC 20.

The power circuit 60 may generate various kinds of source voltages needed for driving of the electroluminescence display apparatus. The power circuit 60 may generate the reference voltage which is to be supplied to the pixels PXL. The power circuit 60 may include a pixel power adjustment circuit which differently generates a first source voltage and a second source voltage, which are to be supplied to the pixels PXL, in display driving and sensing driving.

Figure 3:
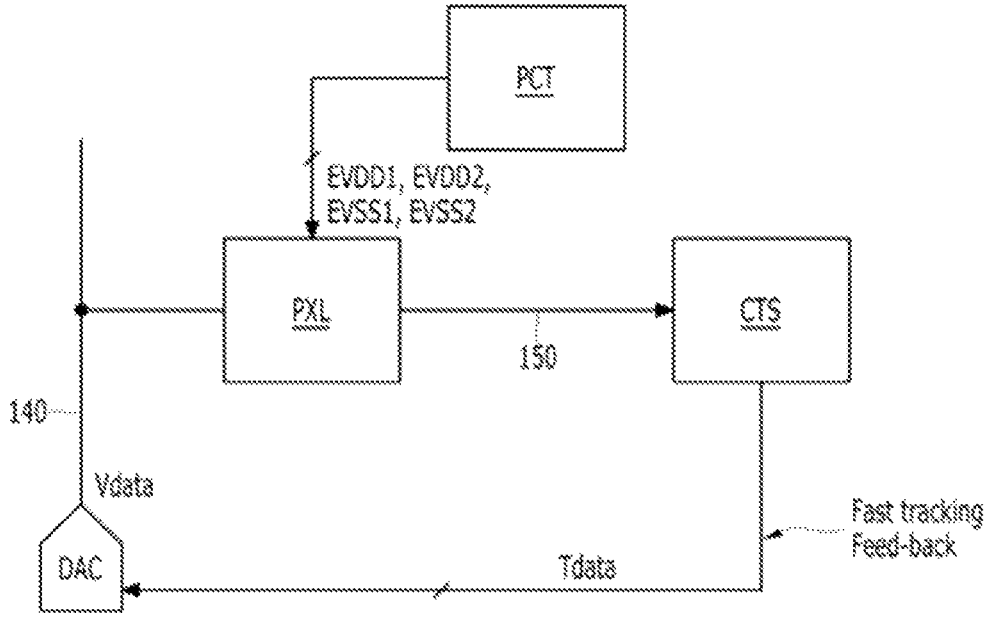
FIG. 3 is a diagram illustrating a driving system for decreasing a threshold voltage sensing time of a driving element in an electroluminescence display apparatus according to the present disclosure.
Figure 4:
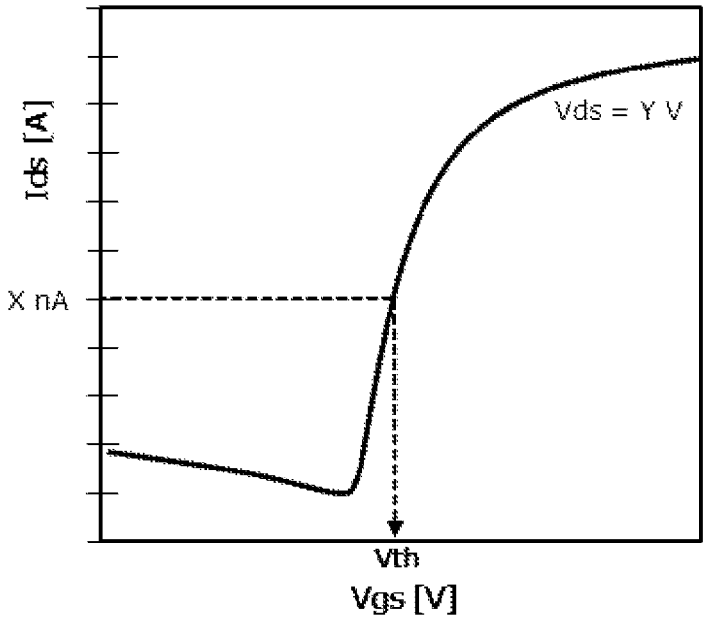
FIG. 4 is a diagram for describing the principle that a threshold voltage of a driving element is calculated based on a specific driving current within a target current range in the driving system of FIG. 3.

FIG. 3 is a diagram illustrating a driving system for decreasing a threshold voltage sensing time of a driving element in an electroluminescence display apparatus according to an aspect of the present disclosure. FIG. 4 is a diagram for describing the principle that a threshold voltage of a driving element is calculated based on a specific driving current within a target current range in the driving system of FIG. 3.

Referring to FIGS. 3 and 4, the electroluminescence display apparatus according to an aspect of the present disclosure may adaptively adjust a data voltage based on a tracking operation of a driving current in sensing driving, thereby decreasing a threshold voltage sensing time of a driving element. To this end, the driving system may include a pixel PXL, a comparison and tracking unit CTS, and a digital-to-analog converter DAC.

The pixel PXL may be connected to a data line 140 and a reference voltage line 150 and may include a driving element and a light emitting device. In sensing driving, the driving element may be supplied with a sensing data voltage through the data line 140, may be supplied with a reference voltage through the reference voltage line 150, and may generate a driving current proportional to a difference voltage between the sensing data voltage and the reference voltage. The driving current may be supplied to the comparison and tracking unit CTS through the reference voltage line 150 instead of being supplied to the light emitting device.

Furthermore, in display driving, the driving element may be supplied with a display data voltage through the data line 140 and may be supplied with the reference voltage through the reference voltage line 150 and may generate a display driving current proportional to a difference voltage between the display data voltage and the reference voltage. The display driving current may be supplied to the light emitting device to allow the light emitting device to emit light.

The comparison and tracking unit CTS may be connected to the pixel PXL through the reference voltage line 150. The comparison and tracking unit CTS may previously determine a target current range between a reference low current and a reference high current and may perform a fast tracking feedback operation based on a current comparison operation until a driving current of the pixel PXL input through the reference voltage line 150 is within the target current range, thereby changing current tracking data TDATA.

For example, as in FIG. 4, a horizontal axis represents a gate-source voltage Vgs of the driving element and a vertical axis represents a drain-source current Ids of the driving element, and in a current characteristic curve where a drain-source voltage Vds of the driving element is Y (where Y is a positive real number) V, the target current range may include the drain-source current Ids having a level of X (where X is a positive real number) nA. In this case, when the drain-source current Ids of the driving element is X nA, the gate-source voltage Vgs of the driving element may be a threshold voltage Vth of the driving element.

The driving element may be an analog element. Therefore, even when the gate-source voltage Vgs is the threshold voltage Vth, the driving element may not be turned off, and as in FIG. 4, the driving current of X nA may flow in the driving element. Because a level of the driving current is far lower than that of a display driving current, a time of the fast tracking feedback operation (i.e., a current comparison and feedback operation) performed by the comparison and tracking unit CTS may be largely shortened. Accordingly, a time (hereinafter reference to as a sensing tack time) taken in detecting the threshold voltage of the driving element may be considerably reduced.

The digital-to-analog converter DAC may adjust a level of a sensing data voltage so as to be proportional to a level of the current tracking data TDATA and may supply the level-adjusted sensing data voltage to the data line 140.

The electroluminescence display apparatus according to an aspect of the present disclosure may further include a pixel power adjustment circuit PCT for preventing a light emitting device included in each pixel PXL from emitting undesired light in sensing driving. This will be described below with reference to FIG. 5.

Figure 5:
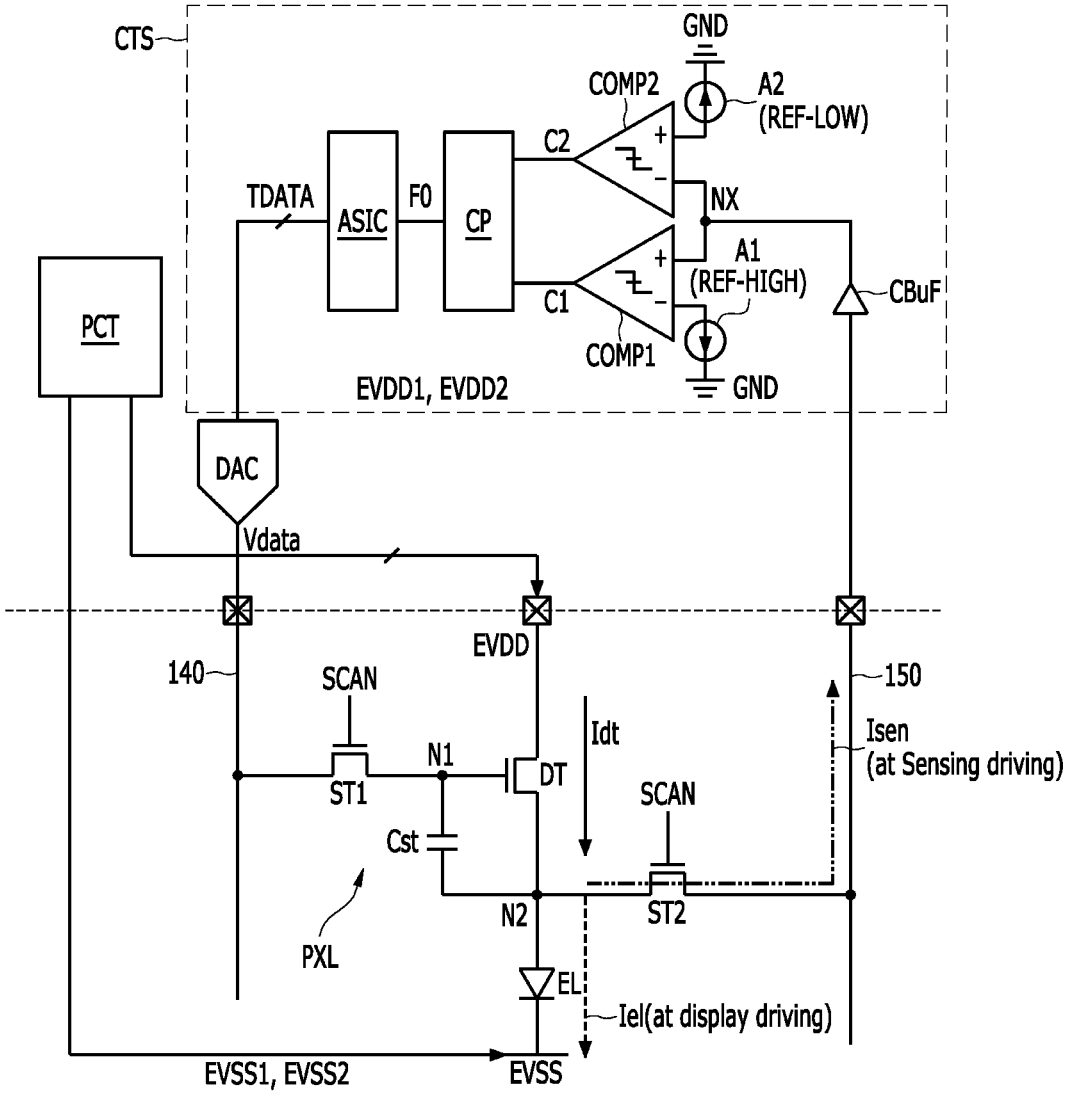
FIG. 5 is a diagram illustrating in detail the driving system of FIG. 3.
Figure 6:
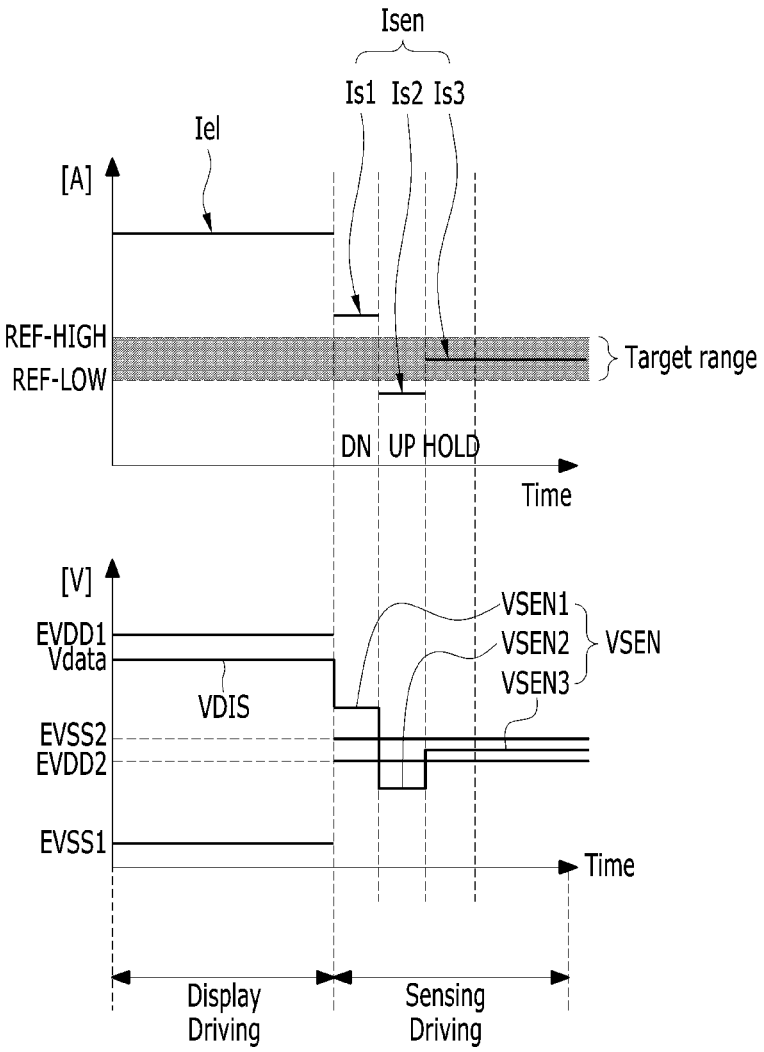
FIG. 6 is a diagram showing an operation waveform of the driving system of FIG. 5.

FIG. 5 is a diagram illustrating in detail the driving system of FIG. 3. FIG. 6 is a diagram showing an operation waveform of the driving system of FIG. 5. FIG. 7 is a diagram illustrating a first source voltage and a second source voltage for display driving and sensing driving in the driving system of FIG. 5. FIG. 8 is a diagram illustrating an example of a current tracking feedback operation performed in the driving system of FIG. 5.

Referring to FIGS. 5 to 8, the electroluminescence display apparatus according to an aspect of the present disclosure may include a pixel PXL, a comparison and tracking unit CTS, and a digital-to-analog converter DAC and may further include a pixel power adjustment circuit PCT.

The pixel PXL may include a light emitting element EL, a driving element DT, switch elements ST1 and ST2, and a storage capacitor Cst. The driving element DT and the switch elements ST1 and ST2 may each be implemented with an NMOS transistor, but are not limited thereto.

The light emitting device EL may emit light with a display driving current Iel supplied from the driving element DT. The light emitting device EL may emit light in only display driving and may not emit light in sensing driving. The light emitting device EL may be implemented with an organic light emitting diode including an organic light emitting layer, or may be implemented with an inorganic light emitting diode including an inorganic light emitting layer. An anode electrode of the light emitting device EL may be connected to a second node N2, and a cathode electrode thereof may be connected to an input terminal for a second source voltage EVSS.

In display driving, the driving element DT may generate a first drain-source current Idt based on a first gate-source voltage (i.e., VDIS-Vref), and the first drain-source current Idt may be the display driving current Iel. In sensing driving, the driving element DT may generate a second drain-source current Idt based on a second gate-source voltage (i.e., VSEN-Vref), and the second drain-source current Idt may be a driving current Isen. A gate electrode of the driving element DT may be connected to a first node N1, a drain electrode thereof may be connected to a first power line PWL through an input terminal for a first source voltage EVDD, and a source electrode thereof may be connected to the second node N2.

The switch elements ST1 and ST2 may be turned on in display driving or sensing driving and may connect the gate electrode of the driving element DT to the data line 140, connect the source electrode of the driving element DT to the reference voltage line 150, and set a gate-source voltage of the driving element DT. The switch elements ST1 and ST2 may be turned on based on the same gate signal SCAN. The switch elements (for example, first and second switch elements) ST1 and ST2 may continuously maintain a turn-on state in sensing driving.

The first switch element ST1 may be connected between the data line 140 and the first node N1 and may be turned on based on the gate signal SCAN from the gate line 160. The first switch element ST1 may be turned on in programming for display driving and may also be turned on in sensing driving. When the first switch element ST1 is turned on, a sensing data voltage VSEN or a display data voltage VDIS may be applied to the first node N1. A gate electrode of the first switch element ST1 may be connected to the gate line 160, a source electrode thereof may be connected to the data line 140, and a drain electrode thereof may be connected to the first node N1.

The second switch element ST2 may be connected between the reference voltage line 150 and the second node N2 and may be turned on based on the gate signal SCAN from the gate line 160. The second switch element ST2 may be turned on in programming for display driving and may apply a reference voltage Vref (shown in FIG. 9), charged into the reference voltage line 150, to the second node N2. In sensing driving, the second switch element ST2 may be turned on, may apply the reference voltage Vref (shown in FIG. 9), charged into the reference voltage line 150, to the second node N2, and may transfer a driving current, generated by the driving element DT, to the reference voltage line 150. A gate electrode of the second switch element ST2 may be connected to the gate line 160, a drain electrode thereof may be connected to the second node N2, and a source electrode thereof may be connected to the reference voltage line 150.

The storage capacitor Cst may be connected between the first node N1 and the second node N2 and may store a gate-source voltage of the driving element DT.

The pixel power adjustment circuit PCT may generate the first source voltage EVDD and may supply the first source voltage EVDD to an input terminal for the first source voltage EVDD through the first power line PWL, and moreover, may generate the second source voltage EVSS and may supply the second source voltage EVSS to an input terminal for the second source voltage EVSS included in the pixel PXL.

In display driving, the pixel power adjustment circuit PCT may generate the first source voltage EVDD having a first value EVDD1 and may generate the second source voltage EVSS having a second value EVSS1. As in FIGS. 6 and 7, because the first value EVDD1 is higher than the second value EVSS1, the light emitting device EL of each pixel PXL may emit light with the display driving current Iel in display driving.

In sensing driving, the pixel power adjustment circuit PCT may generate the first source voltage EVDD having a third value EVDD2 and may generate the second source voltage EVSS having a fourth value EVSS2. As in FIGS. 6 and 7, the third value EVDD2 may be higher than the reference voltage Vref and may be lower than the fourth value EVSS2. Because the third value EVDD2 is higher than the reference voltage Vref, the driving current Isen may be generated in sensing driving. Also, because the third value EVDD2 is lower than the fourth value EVSS2, the driving current Isen may not flow to the light emitting device EL and may flow to the reference voltage line 150 in sensing driving, and the light emitting device EL may be prevented from emitting undesired light.

The comparison and tracking unit CTS may operate in sensing driving and may not operate in display driving. The comparison and tracking unit CTS may compare the driving current Isen, input from the reference voltage line 150, with a predetermined reference low current REF-LOW and a predetermined reference high current REF-HIGH, and thus, may check whether the driving current Isen is within a current period (i.e., a target current range) between the reference low current REF-LOW and the reference high current REF-HIGH. Also, the comparison and tracking unit CTS may perform a fast tracking feedback operation until the driving current Isen is within the target current range, and thus, may change current tracking data TDATA for adjusting a level of the sensing data voltage VSEN.

For example, as in FIG. 6, when a first driving current Is1 corresponding to the first sensing data voltage VSEN1 is higher than the target current range, the comparison and tracking unit CTS may reduce the current tracking data TDATA to allow the second sensing data voltage VSEN2 to be applied to the pixel PXL. Subsequently, when a second driving current Is2 corresponding to the second sensing data voltage VSEN2 is lower than the target current range, the comparison and tracking unit CTS may increase the current tracking data TDATA to allow the third sensing data voltage VSEN3 to be applied to the pixel PXL.

When the driving current Isen having a specific value is within the target current range as a result of the fast tracking feedback operation, the comparison and tracking unit CTS may stop an operation of changing the current tracking data TDATA and may calculate a threshold voltage of the driving element DT based on the driving current Isen having the specific value. In other words, the comparison and tracking unit CTS may calculate a gate-source voltage (VSEN-Vref) of the driving element DT, corresponding to the driving current Isen having the specific value, as the threshold voltage of the driving element DT.

For example, as in FIG. 6, when a third driving current Is3 corresponding to the third sensing data voltage VSEN3 is within the target current range, the comparison and tracking unit CTS may calculate a gate-source voltage (VSEN3-Vref) of the driving element DT, corresponding to the third driving current Is3, as the threshold voltage of the driving element DT.

Here, the gate-source voltage (VSEN3-Vref) of the driving element DT may be a difference voltage between the third sensing data voltage VSEN3, applied to the gate electrode of the driving element DT through the data line 140, and the reference voltage Vref applied to the source electrode of the driving element DT through the reference voltage line 150. The third sensing data voltage VSEN3 may be the sensing data voltage VSEN where a level thereof is adjusted for the third driving current Is3, and the reference voltage Vref may have a fixed level regardless of a level of the driving current Isen.

In order to perform the fast tracking feedback operation, the comparison and tracking unit CTS may include a current buffer CBuF, a first current comparator COMP1, a second current comparator COMP2, a logic circuit CP, and an application specific integrated circuit ASIC.

The current buffer CBuF may supply the reference voltage Vref (shown in FIG. 9) to the reference voltage line 150 and may mirror the driving current Isen input through the reference voltage line 150 to output the mirrored driving current to a node Nx. The current buffer CBuF may prevent a direct connection between the reference voltage line 150 and the node Nx to allow panel noise included in the driving current Isen not to be applied to the first current comparator COMP1 and the second current comparator COMP2. The current buffer CBuF may increase noise immunity to the driving current Isen which is a super-low current.

The first current comparator COMP1 may compare the reference high current REF-HIGH with the driving current Isen input through the node Nx to output a first comparison result signal C1. The first current comparator COMP1 may include a first non-inverting input terminal (+) connected to the node Nx, a first inverting input terminal (−) connected to a first current source A1 which generates the reference high current REF-HIGH, and a first output terminal which outputs the first comparison result signal C1.

Because the first current comparator COMP1 compares the reference high current REF-HIGH of the first inverting input terminal (−) with the driving current Isen input through the first non-inverting input terminal (+), when the driving current Isen is greater than the reference high current REF-HIGH as in FIG. 8, the first current comparator COMP1 may output the first comparison result signal C1 as a high logic value "1", and when the driving current Isen is less than or equal to the reference high current REF-HIGH, the first current comparator COMP1 may output the first comparison result signal C1 as a low logic value "0". Because the reference low current REF-LOW is lower than the reference high current REF-HIGH, a range where the driving current Isen is lower than the reference low current REF-LOW may be included in a range where the driving current Isen is lower than the reference high current REF-HIGH. Even in this case, therefore, as in FIG. 8, the first current comparator COMP1 may output the first comparison result signal C1 as a low logic value "0".

The second current comparator COMP2 may compare the reference low current REF-LOW with the driving current Isen input through the node Nx to output a second comparison result signal C2. The second current comparator COMP2 may include a second inverting input terminal (−) connected to the node Nx, a second non-inverting input terminal (+) connected to a second current source A2 which generates the reference low current REF-LOW, and a second output terminal which outputs the second comparison result signal C2.

Because the second current comparator COMP2 compares the reference low current REF-LOW of the second non-inverting input terminal (+) with the driving current Isen input through the second inverting input terminal (−), when the driving current Isen is less than the reference low current REF-LOW as in FIG. 8, the second current comparator COMP2 may output the second comparison result signal C2 as a high logic value "1", and when the driving current Isen is greater than or equal to the reference low current REF-LOW, the second current comparator COMP2 may output the second comparison result signal C2 as a low logic value "0". Because the reference low current REF-LOW is lower than the reference high current REF-HIGH, a range where the driving current Isen is higher than the reference high current REF-HIGH may be included in a range where the driving current Isen is higher than the reference low current REF-LOW. Even in this case, as in FIG. 8, the second current comparator COMP2 may output the second comparison result signal C2 as a low logic value "0".

The logic circuit CP may be connected to the first output terminal of the first current comparator COMP1 and the second output terminal of the second current comparator COMP2. The logic circuit CP may generate a data adjustment signal FO based on a logic value of the first comparison result signal C1 and a logic value of the second comparison result signal C2.

When the logic value of the first comparison result signal C1 differs from the logic value of the second comparison result signal C2, the logic circuit CP may output one of a down control signal DN and an up control signal UP as a data adjustment signal FO, and when the logic value of the first comparison result signal C1 is the same as the logic value of the second comparison result signal C2, the logic circuit CP may output a hold control signal HOLD as the data adjustment signal FO.

In the aspect of FIG. 8, when the first comparison result signal C1 has a high logic value "1" and the second comparison result signal C2 has a low logic value "0", the logic circuit CP may output the down control signal DN as the data adjustment signal FO. When the first comparison result signal C1 has a low logic value "0" and the second comparison result signal C2 has a high logic value "1", the logic circuit CP may output the up control signal UP as the data adjustment signal FO. When each of the first comparison result signal C1 and the second comparison result signal C2 has a low logic value "0", the logic circuit CP may output the hold control signal HOLD as the data adjustment signal FO.

The application specific integrated circuit ASIC may decrease, increase, or hold the current tracking data TDATA based on the data adjustment signal FO input from the logic circuit CP. The application specific integrated circuit ASIC may decrease a value of the current tracking data TDATA based on the down control signal DN, may increase the value of the current tracking data TDATA based on the up control signal UP, and may hold the value of the current tracking data TDATA unchanged based on the hold control signal HOLD.

The current tracking data TDATA may be supplied from the application specific integrated circuit ASIC to the digital-to-analog converter DAC. Based on a reduction in the current tracking data TDATA, as in FIG. 6, the digital-to-analog converter DAC may generate the second sensing data voltage VSEN2 which is less than the first sensing data voltage VSEN1 which is a previous value and may supply the second sensing data voltage VSEN2 to the data line 140. Accordingly, the driving current Isen output to the reference voltage line 150 by the driving element DT may be the second driving current Is2 which is lower than the first driving current Is1.

Based on an increase in the current tracking data TDATA, as in FIG. 6, the digital-to-analog converter DAC may generate the third sensing data voltage VSEN3 which is greater than the second sensing data voltage VSEN2 which is a previous value and may supply the third sensing data voltage VSEN3 to the data line 140. Accordingly, the driving current Isen output to the reference voltage line 150 by the driving element DT may be the third driving current Is3 which is higher than the second driving current Is2.

Based on holding the current tracking data TDATA, as in FIG. 6, the digital-to-analog converter DAC may generate the third sensing data voltage VSEN3 which is a previous value and may supply the third sensing data voltage VSEN3 to the data line 140. Accordingly, the driving current Isen output to the reference voltage line 150 by the driving element DT may hold the third driving current Is3 which is a previous value.

Furthermore, because the hold control signal HOLD is generated when a driving current of a corresponding pixel is within a target current range, the application specific integrated circuit ASIC may detect a gate-source voltage of a driving element included in the corresponding pixel based on a sensing data voltage corresponding to the hold control signal HOLD and may calculate the gate-source voltage as a threshold voltage of the driving element.

Figure 9:
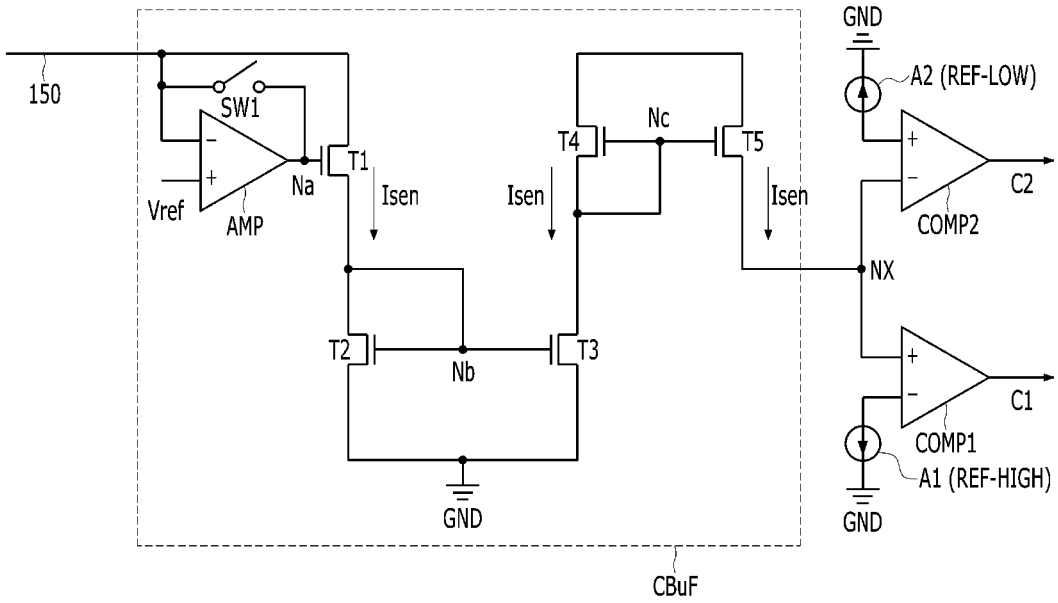
FIG. 9 is a diagram illustrating an example of a current buffer included in the driving system of FIG. 5.

FIG. 9 is a diagram illustrating an example of the current buffer CbuF included in the driving system of FIG. 5. Referring to FIG. 9, the current buffer CbuF may include an input unit, a mirror unit, and an output unit.

The input unit may supply a reference voltage Vref to a reference voltage line 150 and may receive a driving current Isen through the reference voltage line 150.

The input unit may include an input amplifier AMP and an input transistor T1. The input amplifier AMP may include a non-inverting input terminal (+) through which the reference voltage Vref is input, an inverting input terminal (−) connected to the reference voltage line 150, and an output terminal connected to a node Na. The input transistor T1 may include a gate electrode connected to the node Na, a drain electrode connected to the reference voltage line 150, and a source electrode connected to a node Nb. The driving current Isen may be buffered in the input unit and may be supplied to the mirror unit.

The input unit may further include an initial switch SW connected between the inverting input terminal (−) and the output terminal of the input amplifier AMP. The initial switch SW may be turned on in a first period for supplying the reference voltage Vref to the reference voltage line 150 and may be turned off in a second period for receiving the driving current Isen through the reference voltage line 150. When the initial switch SW is turned on in the first period, a time taken in charging the reference voltage Vref into the reference voltage line 150 may be more shortened than a case where there is no initial switch SW, and thus, a sensing tack time may be more reduced.

The mirror unit may be connected to the input unit through the node Nb and may mirror the driving current Isen to allow the driving current Isen to flow in a node Nc. The mirror unit may include a first mirror transistor T2 and a second mirror transistor T3. A gate electrode and a drain electrode of the first mirror transistor T2 may be connected to the node Nb, and a source electrode thereof may be connected to a ground voltage source GND. A gate electrode of the second mirror transistor T3 may be connected to the node Nb, a drain electrode thereof may be connected to the node Nc, and a source electrode thereof may be connected to the ground voltage source GND.

The output unit may be connected to the mirror unit through the node Nc and may output the mirrored driving current Isen to a node Nx. The output unit may include a first output transistor T4 and a second output transistor T5. A gate electrode and a source electrode of the first output transistor T4 may be connected to the node Nc. A gate electrode of the second output transistor T5 may be connected to the node Nc, and a source electrode thereof may be connected to the node Nx. A drain electrode of the first output transistor T4 may be connected to a drain electrode of the second output transistor T5.

Figure 10:
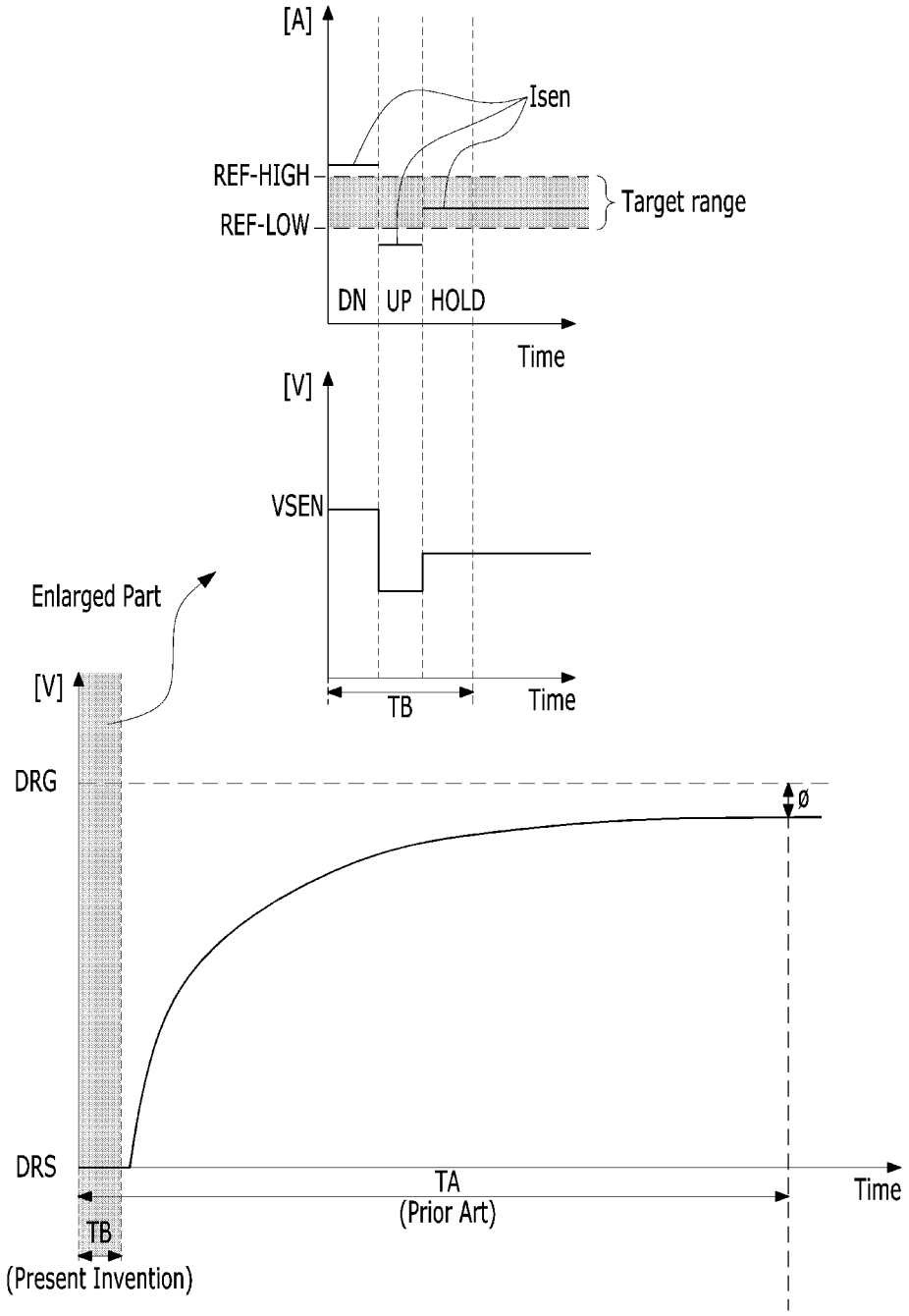
FIG. 10 is a diagram showing a result obtained by comparing a time, taken in detecting a threshold voltage of a driving element in the driving system of FIG. 5, with the prior art.

FIG. 10 is a diagram showing a result obtained by comparing a time, taken in detecting a threshold voltage of a driving element in the driving system of FIG. 5, with the prior art.

As shown in FIG. 6, a level of a first source voltage EVDD and a level of a data voltage may be relatively lower in display driving than sensing driving. With respect to the first source voltage EVDD, EVDD2 for sensing driving may be lower than EVDD1 for display driving. With respect to a data voltage Vdata, a sensing data voltage VSEN may be lower than a display data voltage VDIS. Therefore, a driving current for sensing driving may be lower than a driving current for display driving. In the present aspect, because a driving current which is far lower than a display driving current is a comparison target in detecting a threshold voltage of the driving element, a sensing tack time may be easily reduced.

Furthermore, in order to detect the threshold voltage of the driving element, the prior art has been known where a gate voltage of the driving element is fixed to a sensing data voltage DRG and a source voltage DRS of the driving element increases by using a source follower based on a driving current. Such technology increases the source voltage DRS of the driving element and a voltage of a reference voltage line until a gate-source voltage of the driving element is a threshold voltage φ of the driving element. However, in such technology, due to a parasitic capacitance of the reference voltage line connected to a source electrode of the driving element, because a time (i.e., a sensing tack time TA) taken in detecting the threshold voltage of the driving element is long, real-time sensing based on a vertical blank period is impossible.

On the other hand, the driving system according to the present disclosure may quickly detect the threshold voltage of the driving element in a state where an influence of a parasitic capacitance of the reference voltage line is excluded, based on a fast tracking feedback configuration based on a current comparison operation, and thus, a sensing tack time TB may be considerably reduced compared to the prior art. When the sensing tack time TB is reduced, real-time sensing and compensation may be performed and an update period of a compensation value may be short, and thus, the threshold voltage compensation performance of the driving element may be considerably enhanced.

According to the aspects of the present disclosure, a threshold voltage of a driving element may be quickly detected in a state where a parasitic capacitance influence of a reference voltage line is excluded, based on a fast tracking feedback configuration based on a current comparison operation, and thus, a sensing tack time may be largely reduced. When the sensing tack time is reduced, real-time sensing and compensation may be performed and an update period of a compensation value may be short, and thus, the threshold voltage compensation performance of the driving element may be largely enhanced.

The effects according to the present disclosure are not limited to the above examples, and other various effects may be included in the specification.

While the present disclosure has been particularly shown and described with reference to exemplary aspects thereof, it will be understood by those of ordinary skill in the art that various changes in form and details may be made therein without departing from the spirit and scope of the present disclosure as defined by the following claims.

What is claimed is:

1. An electroluminescence display apparatus comprising:

a pixel connected to a data line and a reference voltage line, the pixel including a driving element configured to generate a driving current based on a sensing data voltage supplied through the data line and a reference voltage supplied through the reference voltage line, wherein a level of the driving current is proportional to a level of the sensing data voltage;

a comparison and tracking circuit configured to determine a target current range between a reference low current and a reference high current in advance and change current tracking data for adjusting a level of the sensing data voltage until the driving current input through the reference voltage line is within the target current range; and a digital-to-analog converter configured to adjust a level of the sensing data voltage so as to be proportional to a size of the current tracking data and supply the level-adjusted sensing data voltage to the data line.

2. The electroluminescence display apparatus of claim 1, wherein, when the driving current having a first value is within the target current range, the comparison and tracking circuit stops an operation of changing the current tracking data and calculates a threshold voltage of the driving element based on the driving current having the first value.

3. The electroluminescence display apparatus of claim 2, wherein the comparison and tracking circuit comprises:

a current buffer configured to supply the reference voltage to the reference voltage line and mirror the driving current input through the reference voltage line to output a mirrored driving current to a first node;

a first current comparator configured to compare the reference high current with the driving current input through the first node to output a first comparison result signal;

a second current comparator configured to compare the reference low current with the driving current input through the first node to output a second comparison result signal;

a logic circuit configured to output a data adjustment signal based on a logic value of the first comparison result signal and a logic value of the second comparison result signal; and an application specific integrated circuit configured to decrease, increase, or hold the current tracking data on based on the data adjustment signal.

4. The electroluminescence display apparatus of claim 3, wherein, when the logic value of the first comparison result signal differs from the logic value of the second comparison result signal, the logic circuit outputs one of a down control signal and an up control signal as the data adjustment signal, and when the logic value of the first comparison result signal is the same as the logic value of the second comparison result signal, the logic circuit outputs a hold control signal as the data adjustment signal.

5. The electroluminescence display apparatus of claim 4, wherein, when the logic value of the first comparison result signal is logic high and the logic value of the second comparison result signal is logic low, the down control signal is output as the data adjustment signal, when the logic value of the first comparison result signal is logic low and the logic value of the second comparison result signal is logic high, the up control signal is output as the data adjustment signal, and when each of the logic value of the first comparison result signal and the logic value of the second comparison result signal is logic low, the hold control signal is output as the data adjustment signal.

6. The electroluminescence display apparatus of claim 5, wherein the application specific integrated circuit configured to:

decrease a value of the current tracking data based on the down control signal, increase the value of the current tracking data based on the up control signal, and hold the current tracking data unchanged based on the hold control signal.

7. The electroluminescence display apparatus of claim 3, wherein the current buffer comprises:

an input circuit configured to supply the reference voltage to the reference voltage line and receive the driving current through the reference voltage line;

a mirror circuit connected to the input circuit through a second node to mirror the driving current; and an output circuit connected to the mirror circuit through a third node to output a mirrored driving current to the first node.

8. The electroluminescence display apparatus of claim 7, wherein the input circuit comprises:

an input amplifier including a non-inverting input terminal through which the reference voltage is input, an inverting input terminal connected to the reference voltage line, and an output terminal connected to a fourth node; and an input transistor including a gate electrode connected to the fourth node, a drain electrode connected to the reference voltage line, and a source electrode connected to the second node.

9. The electroluminescence display apparatus of claim 8, wherein the input circuit further comprises an initial switch connected between the inverting input terminal and the output terminal of the input amplifier, and wherein the initial switch is turned on in a first period for supplying the reference voltage to the reference voltage line and is turned off in a second period for receiving the driving current through the reference voltage line.

10. The electroluminescence display apparatus of claim 3, wherein the first current comparator includes a first non-inverting input terminal connected to the first node and a first inverting input terminal connected to a first current source generating the reference high current, and wherein the second current comparator includes a second inverting input terminal connected to the first node and a second non-inverting input terminal connected to a second current source generating the reference low current.

11. The electroluminescence display apparatus of claim 2, wherein the comparison and tracking circuit calculates a gate-source voltage of the driving element, corresponding to the driving current having the first value, as the threshold voltage of the driving element, the gate-source voltage of the driving element is a voltage difference between a first sensing data voltage, applied to a gate electrode of the driving element through the data line, and the reference voltage applied to a source electrode of the driving element through the reference voltage line, the first sensing data voltage is the sensing data voltage where a level thereof is adjusted so that the driving current has the first value, and the reference voltage has a fixed level regardless of a level of the driving current.

12. The electroluminescence display apparatus of claim 1, wherein the pixel further comprises a first source voltage terminal connected to a drain electrode of the driving element, a light emitting device including an anode electrode connected to a source electrode of the driving element, and a second source voltage terminal connected to a cathode electrode of the light emitting device, wherein a first source voltage applied to the first source voltage terminal is higher than the reference voltage and is lower than a second source voltage applied to the second source voltage terminal, and wherein the driving current does not flow to the light emitting device and flows to the reference voltage line.

13. A driving method of an electroluminescence display apparatus including a pixel which is connected to a data line and a reference voltage line and includes a driving element configured to generate a driving current based on a sensing data voltage supplied through the data line and a reference voltage supplied through the reference voltage line and where a level of the driving current being proportional to a level of the sensing data voltage, the driving method comprising:

predetermining a target current range between a reference low current and a reference high current and changing current tracking data for adjusting a level of the sensing data voltage until the driving current input through the reference voltage line is within the target current range; and adjusting a level of the sensing data voltage so as to be proportional to a size of the current tracking data and supplying the level-adjusted sensing data voltage to the data line.

14. The driving method of claim 13, further comprising, when the driving current having a first value is within the target current range, stopping an operation of changing the current tracking data and calculating a threshold voltage of the driving element based on the driving current having the first value.

15. The driving method of claim 14, wherein the calculating of the threshold voltage of the driving element comprises calculating a gate-source voltage of the driving element, corresponding to the driving current having the first value, as the threshold voltage of the driving element, the gate-source voltage of the driving element is a voltage difference between a first sensing data voltage, applied to a gate electrode of the driving element through the data line, and the reference voltage applied to a source electrode of the driving element through the reference voltage line, the first sensing data voltage is the sensing data voltage where a level thereof is adjusted so that the driving current has the first value, and the reference voltage has a fixed level regardless of a level of the driving current.

* * * * *